United States Patent [19]

Haddox

[11] Patent Number: 4,956,937

[45] Date of Patent: Sep. 18, 1990

[54] HANGER FOR PLANT CONTAINER

[76] Inventor: Holly A. Haddox, 1001 S. Main, St. Charles, Mo. 63301

[21] Appl. No.: 293,217

[22] Filed: Jan. 4, 1989

[51] Int. Cl.[5] ..... A47G 7/00

[52] U.S. Cl. ..... 47/67; 248/323; 211/117

[58] Field of Search ..... 47/67; 211/117; 248/318, 323, 327, 328; 294/74, 149, 150, 157; 24/169, 172, 183

[56] References Cited

U.S. PATENT DOCUMENTS

| | | | |
|---|---|---|---|
| 820,710 | 5/1906 | Ford | 24/169 |
| 1,272,273 | 7/1918 | Kell | 248/328 |
| 2,532,306 | 12/1950 | Herbert | 294/150 |
| 2,565,978 | 8/1951 | Meriwether | 248/327 |
| 3,120,403 | 2/1964 | Molzan | 294/149 X |
| 3,339,965 | 9/1967 | Berns | 294/74 |
| 3,395,882 | 8/1968 | Marshall | 248/318 |
| 3,625,559 | 12/1971 | Lawrence | 294/74 |
| 3,865,292 | 2/1975 | Foley | 294/149 |
| 4,032,102 | 6/1977 | Wolf et al. | 47/67 |
| 4,385,742 | 5/1983 | Rocquin | 248/318 |
| 4,669,693 | 6/1987 | Kagan | 47/67 X |

FOREIGN PATENT DOCUMENTS

| | | | |
|---|---|---|---|
| 535156 | 1/1922 | France | 24/169 |

*Primary Examiner*—Richard E. Chilcot, Jr.
*Assistant Examiner*—Jerrold D. Johnson
*Attorney, Agent, or Firm*—Senniger, Powers, Leavitt and Roedel

[57] ABSTRACT

A hanger adapted for suspending a plant container or the like from a fixed support. The hanger comprises a plurality of flexible straps having upper reaches terminating in upper extremities adapted for connection to the fixed support and lower reaches terminating in lower extremities adapted for disposition adjacent the plant container, and supporters on the lower extremities of the straps for supporting the container. Each strap has an effective length defined by the distance between its upper and lower extremities. The effective length of each strap is adjustable independent of the adjustment of the other straps for varying the position of the plant with respect to the fixed support.

13 Claims, 3 Drawing Sheets

FIG. 4.
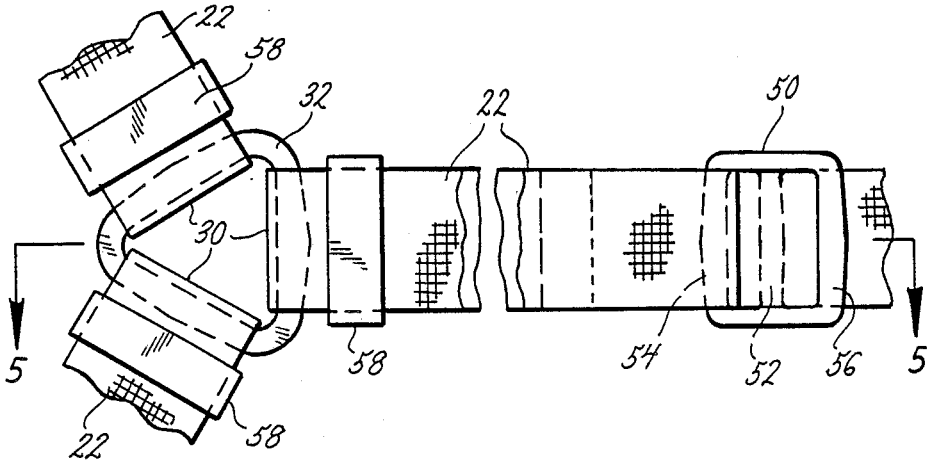
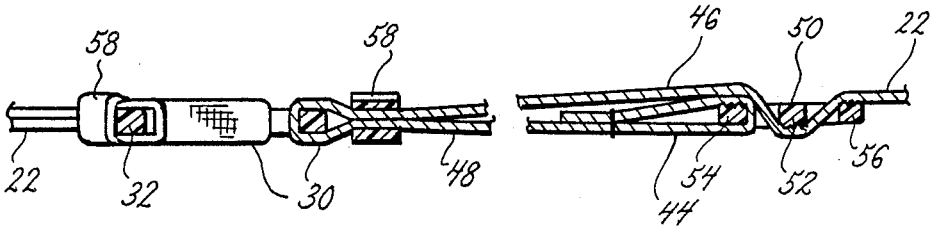
FIG. 5.

HANGER FOR PLANT CONTAINER

BACKGROUND OF THE INVENTION

This invention relates generally to hangers, and in particular to a hanger for suspending a plant container or the like from a fixed support.

Plant hangers having cords or ropes for suspending a potted plant from a fixed support have been widely used. However, a significant disadvantage of presently available hangers is the lack of means for adjusting the distance between the potted plant and the fixed support. As a result, the length of the cords of the plant hanger may cause the plant container to hang at an undesirable height, i.e., too close or too far from the fixed support. In addition, because the cords of presently available hangers lack the requisite adjustability, retailers must carry a variety of sizes to fit different sizes of plant containers.

SUMMARY OF THE INVENTION

Among the objects of the present invention may be noted the provision of a hanger which is capable of varying the position of a plant container with respect to a fixed support; the provision of such a hanger which is capable of suspending plant containers of various sizes; the provision of such a hanger which has a plurality of suspension strands the lengths of which can be quickly and easily varied to accommodate containers of various sizes and to adjust the elevation of the plant container with respect to the fixed support; and the provision of such a hanger which is of relatively simple and inexpensive construction.

Generally, the hanger of the present invention is adapted for suspending a plant container or the like from a fixed support. The hanger comprises a plurality of flexible straps having upper reaches terminating in upper extremities adapted for connection to the fixed support and lower reaches terminating in lower extremities adapted for disposition adjacent the plant container, and support means on the lower extremities of the straps for supporting the container. Each strap has an effective length defined by the distance between its upper and lower extremities and comprises means for adjusting the effective length of each strap independent of the adjustment of the other straps for varying the position of the plant with respect to the fixed support.

These and other advantages will be in part apparent and in part pointed out hereinafter.

BRIEF DESCRIPTION OF THE DRAWINGS

FIG. 4 is a plan view of the bottom of the hanger showing lower reaches of the straps connected to a polygonal ring;

FIG. 5 is a cross-sectional view taken along line 5—5 of FIG. 4 showing a buckle slidably securing an end portion of the strap to an intermediate portion of the strap;

Corresponding reference numerals indicate corresponding parts throughout the several views of the drawings.

DETAILED DESCRIPTION OF A PREFERRED EMBODIMENT

Figure 1:
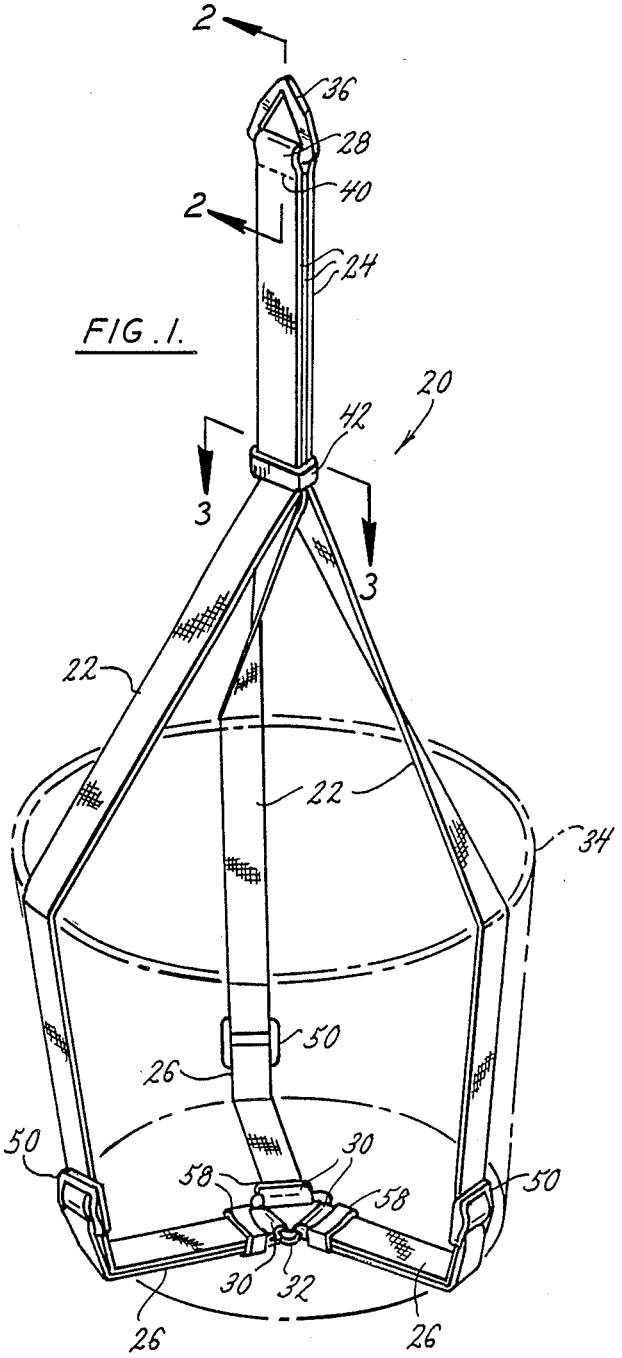
FIG. 1 is a perspective view of a hanger of the present invention.

A hanger, for suspending a plant container or the like from a fixed support, constructed according to the principles of this invention is indicated generally as 20 in FIG. 1. It comprises a plurality (preferably three) of flexible suspension straps 22 having upper reaches 24 and lower reaches 26. The upper reaches 24 terminate in upper extremities 28 adapted for connection to a fixed support (not shown). The lower reaches 26 terminate in lower extremities 30 whicn are connected together by a ring 32. The ring 32 connects the lower extremities 30 together to form a cradle for holding the plant container 34. Thus, ring 32 constitutes support means for supporting container 34. Each strap 22 has an effective length defined by the distance between irs upper and lower extremities 28 and 30. The effective length of each strap 22 is adjustable independent of the adjustment of the other straps to vary the position of container 34 with respect to the fixed support.

Figure 2:
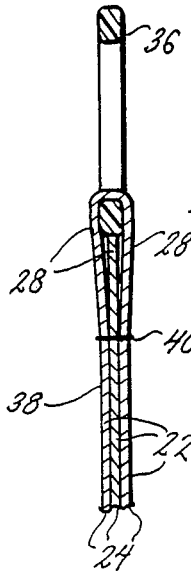
FIG. 2 is an enlarged cross-sectional view taken along line 2—2 of FIG. 1 showing upper reaches of flexible straps.

As shown in FIG. 2, two of the three straps 22 are formed of one elongate strand 38 looped around one side of a ring 36, adapted for connection to the fixed support. The third strap 22 is positioned between and secured to the other two straps 22 by stitching 40. It is to be understood that two separate straps joined together could be used in place of elongate strand 38 without departing from the principles of this invention. Additionally, although hanger 20 is described as having three straps 22, the principles of this invention could be applied to form a hanger having more than three straps.

Figure 3:
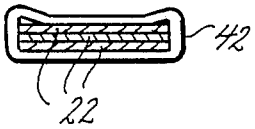
FIG. 3 is an enlarged cross-sectional view taken along line 3—3 of FIG. 1 showing a sleeve around the straps.

A sleeve 42 (shown in FIG. 3) fits snugly over and is slidable along straps 22 for adjusting the stability of container 34. Sliding sleeve 42 downwardly toward container 34 reduces the chance of container 34 falling out of the cradle formed by straps 22. Sliding sleeve 42 upwardly away from container 34 permits a user to more easily remove container 34 from the cradle.

Reference is now made to FIGS. 4 and 5 which show the independent adjustability of the effective length of each strap 22. For simplicity, only one strap will be described in detail. However, it is to be understood that such description applies to the other straps as well. An end portion 44 of strap 22 is doubled back on an intermediate portion 46 of strap 22 to form a loop 48. A buckle 50, adapted for sliding along the intermediate portion 46, is secured to the end portion 44. The buckle 50 constitutes slide fastener means for slidably fastening end portion 44 to intermediate portion 46 and comprises three generally parallel spaced-apart members; one member constitutes a central member 52 and the other members constitute first and second outer members, 54 and 56, respectively. End portion 44 of strap 22 is secured to the first outer member 54. The intermediate portion 46 of strap 22 is threaded between the first outer member 54 and central member 52, about the central member 52, and between the central member 52 and second outer member 56. Sliding buckle 50 along intermediate portion 46 varies the size of loop 48 and, thus, varies the effective length of strap 22. In this preferred embodiment, the loops 48 are shown as being at the lower reaches 26 of straps 22. However, in another embodiment (not shown) the loops could, instead, be disposed about the upper reaches of the straps for adjusting the effective length of the straps.

To connect each of the lower extremities 30 together, each loop 48 is looped around ring 32. A restraining sleeve 58, slidably connected to strap 22, keeps the lower extremity 30 adjacent to ring 32 at times when the size of loop 48 is not being varied. When the size of loop 48 is varied, sleeve 58 is slid away from extremity 30 and strap 22 is then pulled through sleeve 58. After the size of loop 48 has been adjusted, sleeve 58 is slid back toward extremity 30. Thus, sleeve 58 keeps extremity 30 positioned adjacent to ring 32 but does not substantially impair adjustability of the effective length of strap 22.

Preferably, ring 32 is a polygonal ring having a number of sides equal to the number of straps 22 connected thereto. As shown, ring 32 has three sides with each side being engaged to one of the straps. However, if a modified hanger had four straps, for example, joined by a ring, such ring would preferably have four sides with each side being engaged to one of the straps. Joining straps 22 with a polygonal ring minimizes bunching of the lower extremities 30 on ring 32. Preferably, straps 22 comprise flat relatively narrow strips made of a polypropylene webbing. It is to be understood that straps 22 could also be formed of nylon or other similar material.

Figure 6:
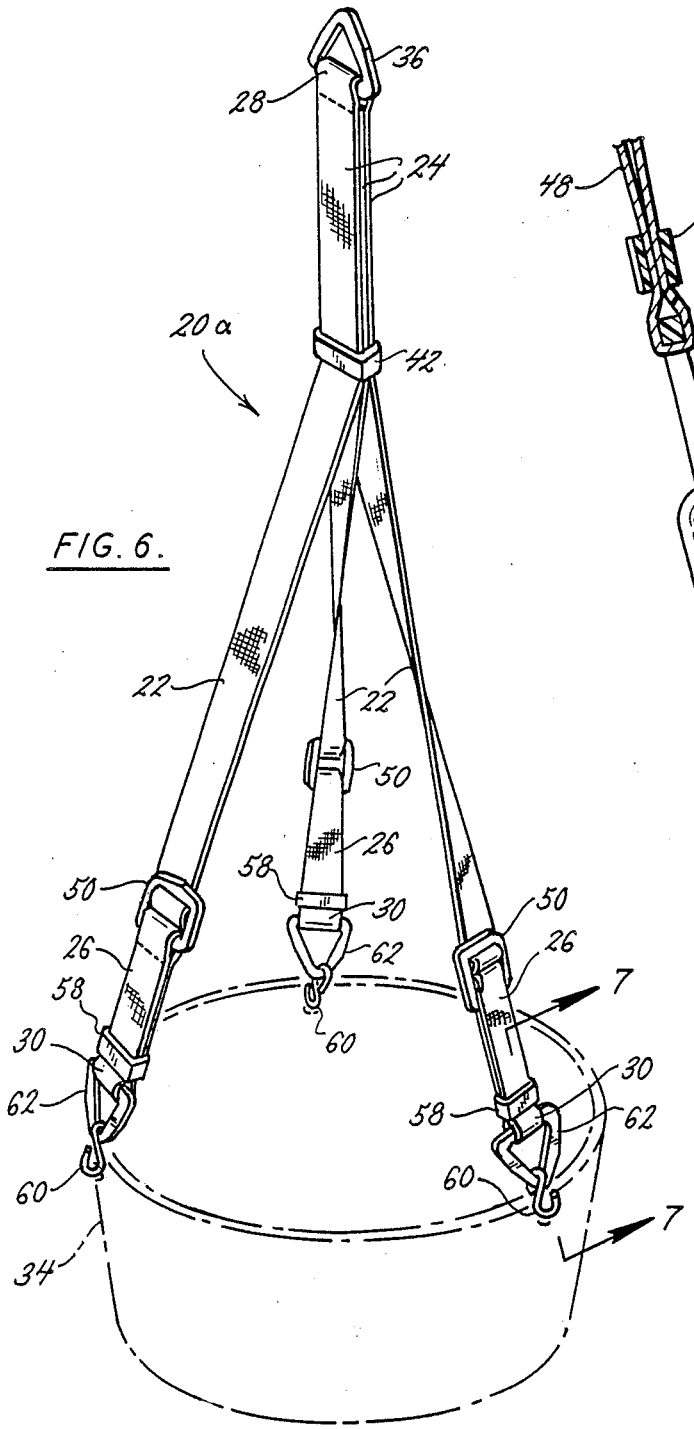
FIG. 6 is a perspective view of another embodiment of the present invention.
Figure 7:
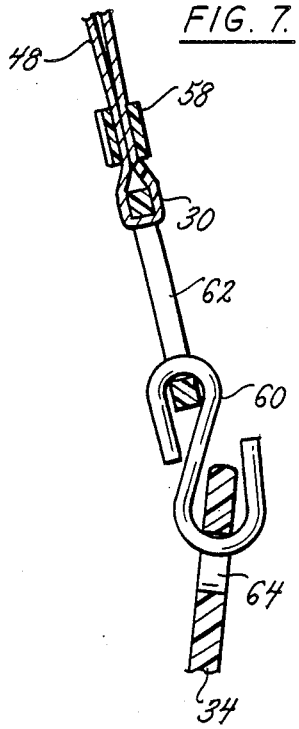
FIG. 7 is an enlarged cross-sectional view taken along line 6—6 of FIG. 7 showing a lower reach of a strap connected to a plant container.

In FIGS. 6 and 7 is shown an alternative preferred embodiment of a hanger, indicated generally at **20*a*, in which the lower extremities are adapted for connection to the container 34. For convenience corresponding parts are numbered identically as those parts shown in FIGS. 1–5. Hooks 60 are connected to the lower extremities 30 of straps 22 by corresponding rings 62. Each loop 48 is looped around its corresponding ring 62 and one of the hooks 60 is secured to such ring 62. The hooks 60 are adapted to releasably engage apertures 64 through the upper margin of container 34 and thereby support container 34. Thus, hooks 60 constitute means for supporting container 34**.

In both of the preferred embodiments, hanger 22 is capable of varying the position of container 34 with respect to a fixed support by sliding buckles 50 along intermediate portions 46 to increase or decrease the effective lengths of straps 22. If suspension of a large plant container is desired, the effective lengths can be increased. If suspension of a small plant container is desired, the effective lengths can be decreased. Additionally, varying the effective lengths permits a user to vary the elevation of the container with respect to the fixed support. As shown and described, hanger 22 has a minimum of parts, and is of relatively simple and inexpensive construction.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A hanger for suspending a plant container of the like from a fixed support, said hanger comprising a plurality of flexible straps having upper reaches terminating in upper extremities adapted for connection to said fixed support and lower reaches terminating in lower extremities adapted for disposition adjacent the plant container, support means on said lower extremities of the straps for supporting the container, each strap having an effective length defined by the distance between its upper and lower extremities, and means for adjusting the effective length of each strap independent of the adjustment of the other straps for varying the position of the plant with respect to said fixed support, each strap including an end portion and an intermediate portion, the end portion of each strap being doubled back on the intermediate portion of the strap to form a loop, said adjustment means comprising slide fastener means slideably fastening the end portion of the strap to the intermediate portion of the strap, said slide fastener means being slideable along the intermediate portion of the strap to vary the size of said loop and thereby adjust the effective length of the strap, the support means comprising the means for connecting the lower reaches of straps together int relatively close proximity to one another to form a cradle for holding the container in a position above said support means.

2. A hanger as set forth in claim 1 wherein said slide fastener means comprises a buckle slidable along the intermediate portion of each strap, the end portion of the strap being secured to the buckle.

3. A hanger as set forth in claim 2 wherein each buckle comprises three generally parallel spaced-apart members, one of the members constituting a central member and the other members constituting first and second outer members, and wherein the intermediate portion of the strap is threaded between the first outer member and central member, over the central member and between the central and second outer member.

4. A hanger as set forth in claim 1 wherein the loops are at the lower reaches of the straps.

5. A hanger as set forth in claim 1 wherein the straps comprise flat relatively narrow strips.

6. A hanger as set forth in claim 5 wherein the straps comprise a nylon weave material.

7. A hanger as set forth in claim 5 wherein said connecting means comprises a ring, the loop of each strap being looped around the ring.

8. A hanger as set forth in claim 7 wherein the rises a polygonal ring having a number of sides equal to the number of straps connected thereto, each side being engageable with one of the straps.

9. A hanger as set forth in claim 8 further comprising means for restraining the ring from sliding about the loops.

10. A hanger for suspending a plant container or the like from a fixed support, said hanger comprising a plurality of flexible straps having upper reaches terminating in upper extremities adapted for connection to said fixed support and lower reaches terminating in lower extremities adapted for disposition adjacent the plant container, support means on said lower extremities of the straps for supporting the container, each strap having an effective length defined by the distance between its upper and lower extremities, and means for adjusting the effective length of each strap independent of the adjustment of the other straps for varying the position of the plant with respect to said fixed support, each strap including an end portion and an intermediate portion, the end portion of each strap being doubled back on the intermediate portion of the strap to form a loop with the loop being at the lower reach of the strap, said adjustment means comprising slide fastener means slideably fastening the end portion of the strap to the intermediate portion of the strap, said slide fastener means being slideable along the intermediate portion of the strap to vary the size of said loop and thereby adjust the effective length of the strap, the support means comprising a hook connected to the loop of each strap, each hook being connected to a respective loop by a ring, the loop being looped around the ring and the hook being secured to the ring, each hook being engageable with the plant container for supporting the plant container.

11. A hanger as set forth in claim 10 further comprising means for restraining each ring from sliding about the loop to which it is connected.

12. A hanger as set forth in claim 10 wherein the straps comprise flat relatively narrow strips.

13. A hanger as set forth in claim 12 wherein the straps comprise a polypropylene webbing material.

* * * * *